US009884703B2

(12) United States Patent
Laib et al.

(10) Patent No.: US 9,884,703 B2
(45) Date of Patent: Feb. 6, 2018

(54) CONTAINER, HANDLE FOR A CONTAINER, AND HANDLE AND CONTAINER ASSEMBLY

(71) Applicant: Owens-Brockway Glass Container Inc., Perrysburg, OH (US)

(72) Inventors: Douglas Laib, Perrysburg, OH (US); Karl A. Reisig, Maumee, OH (US); Sorcha Sayers, Fairfield, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 2 days.

(21) Appl. No.: 14/753,535

(22) Filed: Jun. 29, 2015

(65) Prior Publication Data

US 2015/0298858 A1 Oct. 22, 2015

Related U.S. Application Data

(62) Division of application No. 13/656,002, filed on Oct. 19, 2012, now abandoned.

(51) Int. Cl.
*B65D 23/10* (2006.01)

(52) U.S. Cl.
CPC ..... *B65D 23/106* (2013.01); *B65D 23/104* (2013.01)

(58) Field of Classification Search
CPC ..... B65D 1/023; B65D 23/10; B65D 23/102; B65D 23/104; B65D 23/106; B65D 25/2817
USPC ..... 215/396; 220/710.5, 752, 756, 758, 759, 220/762, 769, 770, 776
See application file for complete search history.

(56) References Cited

U.S. PATENT DOCUMENTS

| | | | |
|---|---|---|---|
| 2,598,747 | A | 6/1952 | Alex |
| 2,610,081 | A | 9/1952 | Bushman |
| 3,021,026 | A | 2/1962 | Clare |
| 3,717,288 | A | 2/1973 | Schlegel |
| 4,273,246 | A | 6/1981 | Thompson |
| 4,379,578 | A | 4/1983 | Schuler |
| 4,456,135 | A | 6/1984 | Beekes |
| 4,552,276 | A | 11/1985 | Buch |
| 4,768,403 | A | 9/1988 | Bar-Noy |
| 4,962,868 | A | 10/1990 | Borchard |
| 4,982,869 | A | 1/1991 | Robbins, III |
| 5,149,160 | A | 9/1992 | Iida et al. |

(Continued)

FOREIGN PATENT DOCUMENTS

| | | | |
|---|---|---|---|
| GB | 2035972 | A | 6/1980 |
| GB | 2268922 | A | 1/1994 |

(Continued)

OTHER PUBLICATIONS

PCT Search Report and Written Opinion, Int. Serial No. PCT/US2013/060526, Int. Filing Date: Sep. 19, 2013, Applicant: Owens-Brockway Glass Container Inc., dated Jul. 18, 2014.

*Primary Examiner* — Fenn C Mathew
*Assistant Examiner* — Madison L Poos

(57) ABSTRACT

A container may include a neck including an external surface and at least one handle retention feature with axially lower and upper handle retention surfaces. A handle for a container may include a collar including spaced apart container retention features having axially lower and upper container retention surfaces to cooperate with the corresponding handle retention feature of the container to prevent axial movement of the collar with respect to the container.

9 Claims, 8 Drawing Sheets

(56) References Cited

U.S. PATENT DOCUMENTS

| | | | | |
|---|---|---|---|---|
| 5,297,686 | A | 3/1994 | Takeuchi | |
| 5,487,482 | A | 1/1996 | Rocheleau | |
| D493,675 | S * | 8/2004 | Panico | D7/622 |
| 6,926,163 | B2 | 8/2005 | Darr et al. | |
| D598,746 | S | 8/2009 | Caldwell | |
| D598,747 | S | 8/2009 | Caldwell | |
| 7,684,038 | B1 | 1/2010 | Brozell | |
| 2005/0082251 | A1 | 4/2005 | Darr et al. | |
| 2005/0236356 | A1 | 10/2005 | Lonsway | |
| 2007/0221607 | A1 | 9/2007 | Piccioli et al. | |
| 2007/0221608 | A1 | 9/2007 | Axe et al. | |
| 2007/0272651 | A1 | 11/2007 | DiPasquale et al. | |

FOREIGN PATENT DOCUMENTS

| | | |
|---|---|---|
| WO | 9911530 | 3/1999 |
| WO | 2012042025 | 4/2005 |
| WO | 2005108047 | 11/2005 |

* cited by examiner

CONTAINER, HANDLE FOR A CONTAINER, AND HANDLE AND CONTAINER ASSEMBLY

The present disclosure is directed to containers and, more particularly, to handles for containers, and related packages.

BACKGROUND AND SUMMARY OF THE DISCLOSURE

Bottles and jugs are usually molded from glass or plastic. A bottle typically includes a base on which the bottle is supported, a body extending from the base to hold liquid, a shoulder extending from the body, and a neck extending from the shoulder and having an open mouth through which liquid flows out of the bottle. A jug is similar to a bottle but also includes an integrally molded handle extending from the neck.

A general object of the present disclosure, in accordance with one aspect of the disclosure, is to provide a container handle and a container having novel features for attachment of the handle to the container, and a novel container and handle assembly.

The present disclosure embodies a number of aspects that can be implemented separately from or in combination with each other.

A handle and container assembly in accordance with one aspect of the disclosure includes a container including a base, a body extending from the base, a shoulder extending from the body, and a neck extending from the shoulder and including an external surface having a handle retention feature with axially lower and upper handle retention surfaces that face away from one another. The assembly also includes a handle including a collar surrounding the neck of the container and having axially spaced apart container retention features that engage the axially lower and upper handle retention surfaces of the handle retention feature of the container neck, to prevent axial movement of the collar with respect to the container neck.

In accordance with another aspect of the disclosure, there is provided a one-piece handle for a container. The handle includes a frustoconical collar including axially spaced apart container retention features having axially lower and upper container retention surfaces that face one another to retain therebetween a corresponding handle retention feature of a container to prevent axial movement of the collar with respect to the container.

In accordance with another aspect of the disclosure, there is provided a container that includes a base, a body extending from the base, a shoulder extending from the body, and a neck extending from the shoulder. The neck includes an axial end surface, a radially outer surface, an annular flange spaced apart from the axial end surface and extending outwardly from the outer surface, and at least one handle retention feature located axially between and spaced apart from the annular flange and the shoulder and having axially lower and upper handle retention surfaces that face away from one another.

In accordance with another aspect of the disclosure, there is provided a handle and container assembly that includes a container having a neck and a handle having a collar externally surrounding the container neck. The container neck has an external surface and a pair of handle retention features spaced axially from each other, and at least one anti-rotation feature extending between the handle retention features. The handle collar has internal container retention features that engage the handle retention features on the container neck to prevent axial movement of the collar and the handle with respect to the neck and the container, and the collar has at least one corresponding anti-rotation feature extending between the container retention features and engaging the at least one anti-rotation feature of the container to prevent rotation of the collar and the handle with respect to the neck and the container.

In accordance with another aspect of the disclosure, there is provided a handle and container assembly that includes a container having a neck with an external surface and at least one external embossment or debossment on the external surface. The assembly also includes a handle that includes a circumferentially continuous one-piece annular collar received by interference fit over the neck, the collar including at least one internal debossment or embossment engaged with the at least one external embossment or debossment on the neck to prevent movement of the collar and the handle with respect to the neck and the container.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 3:
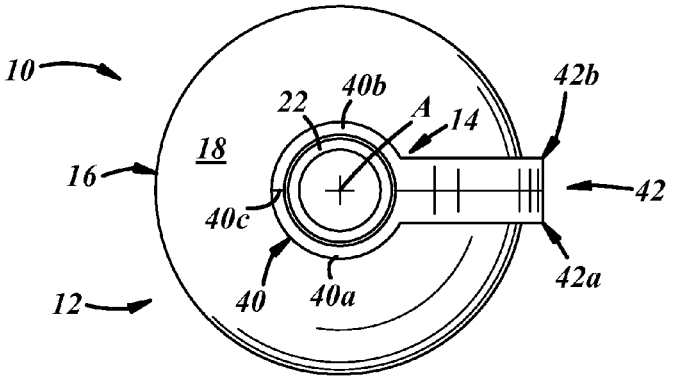
FIG. 3 is a top view of the container and handle assembly of FIG. 1.
Figure 1:
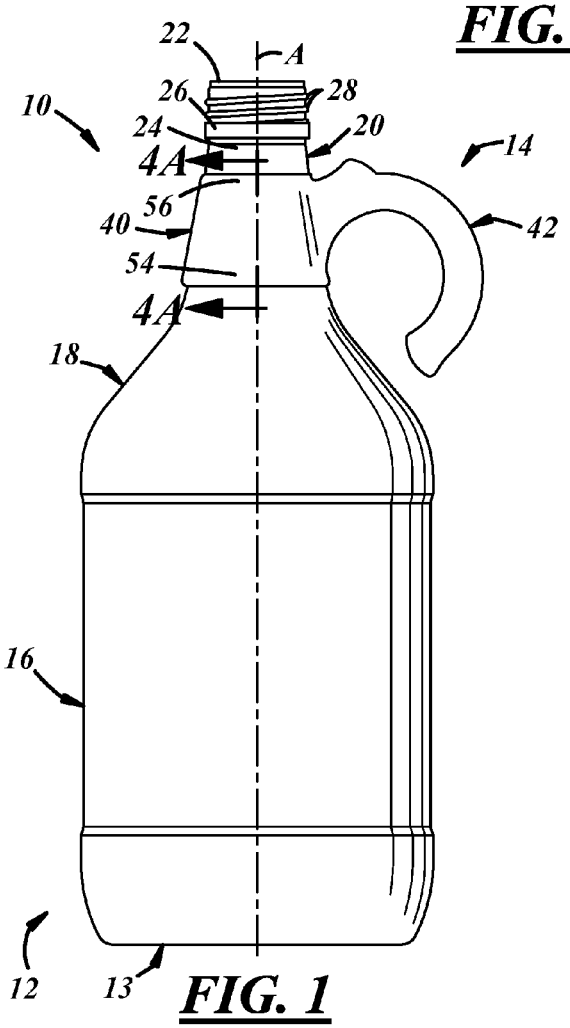
FIG. 1 is a side elevational view of a container and handle assembly in accordance with an illustrative embodiment of the present disclosure.
Figure 2:
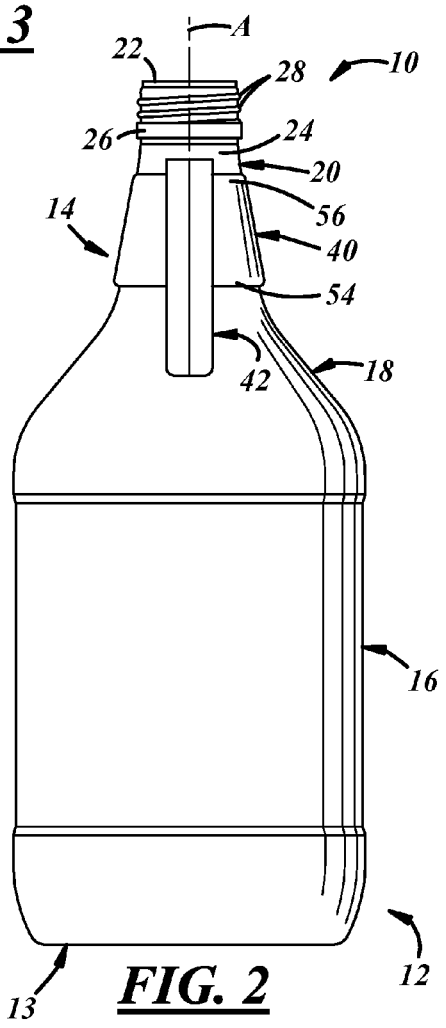
FIG. 2 is a rear elevational view of the container and handle assembly of FIG. 1.

FIGS. 1 and 2 illustrate a product that includes a handle and container assembly 10, and that also may include a closure (not shown). The illustrated assembly 10 includes a container 12 and a handle 14 coupled to the container 12. The assembly 10 includes a longitudinal axis A along which the container 12 generally extends, also along which the handle 14 may be applied to and removed from the container 12, and about which a portion of the handle 14 may be rotated. In one embodiment, the product including the assembly 10 may include a beverage package, and may be used to contain beverages, like wine, beer, soda, etc. Accordingly, the product may be a wine jug, beer growler, soda bottle, or the like. As used herein, directional words such as top, bottom, upper, upward, downward, lower, radial, circumferential, lateral, longitudinal, transverse, vertical, horizontal, and the like are employed by way of description and not necessarily limitation.

The container 12 may be of one-piece integrally formed construction, preferably glass, plastic, or metal construction. (The term "integrally formed construction" does not exclude one-piece integrally molded layered glass constructions of the type disclosed for example in U.S. Pat. No. 4,740,401, or one-piece glass or metal bottles to which other structure is added after the bottle-forming operation.) The container 12 may be fabricated in press-and-blow or blow-and-blow glass container manufacturing operations, in a plastic injection and/or blow molding operation, in a metal drawing operation, or in any other suitable manner.

The container 12 includes a base 13 on which the container 12 may be supported, a body 16 extending in a direction generally axially from the base, a shoulder 18 extending radially and axially from the body 16, and a neck 20 extending in a direction generally axially from the shoulder 18. As used herein, the term axial includes oriented generally along a longitudinal axis of the closure, container, or package and may include but is not limited to a direction that is strictly parallel to the axis.

The neck 20 includes a lip or axial end surface 22, a radially outwardly facing external surface 24, a radially outer annular flange 26 radially extending from the external surface 24, and a closure retention feature 28 extending in a direction generally radially outwardly from the external surface 24 and in a location axially between the annular flange 26 and the axial end surface 22. The neck 20 may include only a single one of the annular flange 26. The neck 20 may be frustoconical or at least the external surface 24 of the neck 20 may be frustoconical. The annular flange 26 may be a capping flange, or any other suitable flange. The closure retention feature 28 may include one or more thread segments, a crown, or the like. As used herein, the term thread segment includes whole, partial, multiple, and/or an interrupted thread and/or thread segment.

Figure 4B:
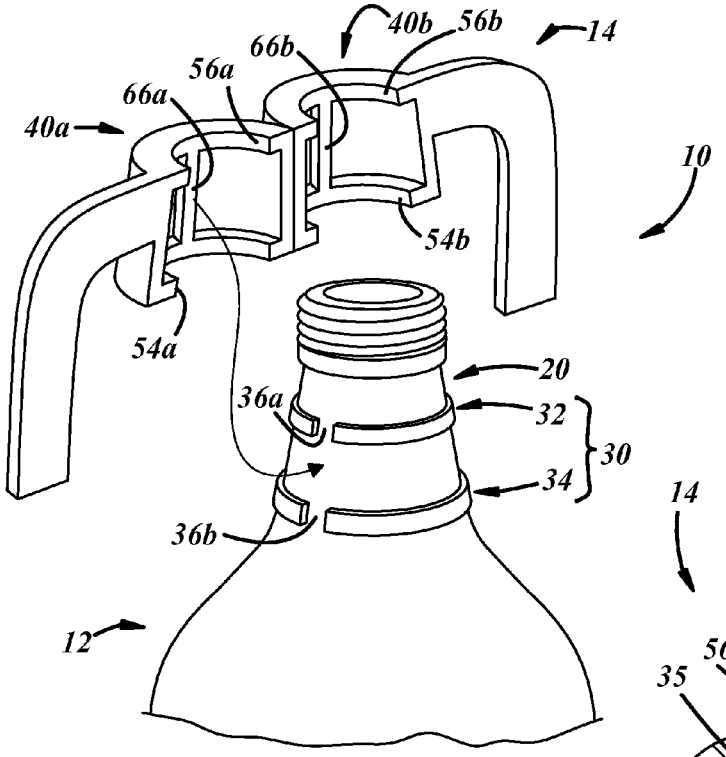
FIG. 4B is a fragmentary, exploded, perspective view of the container and handle assembly of FIG. 1.
Figure 4A:
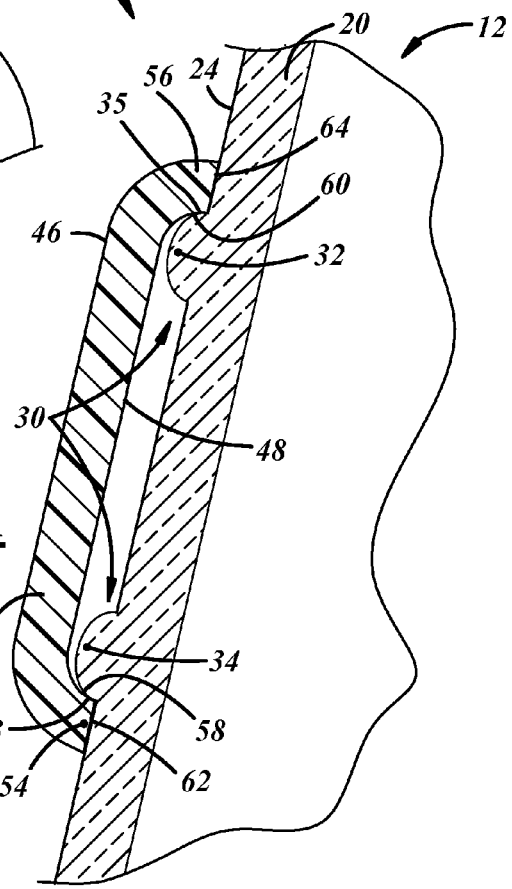
FIG. 4A is an enlarged, fragmentary, cross-sectional view of the container and handle assembly of FIG. 1, taken along line 4A-4A of FIG. 1.

Referring now to FIG. 4A, the neck 20 also includes a handle retention feature 30 that extends from the external surface 24 of the container neck 20. The handle retention feature 30 may include one or more projections or embossments, or depressions or debossments. For example, as illustrated the feature 30 may include a pair of axially spaced apart annular ribs or projections 32, 34. In another embodiment, the handle retention feature 30 may include a single large annular band that may span the axial length of, but replace, both projections 32, 34. In yet another embodiment, the feature 30 may include one or more depressions in the container wall instead of the projections on the wall. The handle retention feature 30 is located axially between and spaced apart from the annular flange 26 and the shoulder 18 and includes axially lower and upper handle retention surfaces 33, 35 that face away from one another, for example, in axially opposite directions.

Referring now to FIG. 4B, on the container 12, the handle retention feature 30 also may include an anti-rotation feature 36*a*, 36*b* extending between the pair of annular projections 32, 34. The anti-rotation feature 36*a*, 36*b* may include a discontinuity or gap in the annular projections 32, 34, as illustrated, but also or instead may include a depression in the outer surface of the neck 20. Likewise, the handle 14 also may include another container retention feature 66*a*, 66*b* to engage the anti-rotation feature 36*a*, 36*b* of the container 12. In this embodiment, the retention feature 66*a*, 66*b* may include a longitudinal projection or rib that fits in the anti-rotation feature 36*a*, 36*b* of the container 12.

Referring to FIG. 1, the handle 14 may be of one-piece integrally formed construction, preferably plastic or metal construction. In other embodiments, the handle 14 may be constructed from two or more separate pieces. The handle 14 may be fabricated in an injection molding operation, a stamping operation, or in any other suitable manner. The handle 14 includes a collar 40 surrounding the neck 20 of the container 12 and a handle arm 42 extending from the collar 40. The collar 40 may be coupled to the container neck 20 below the annular flange 26 and/or above the shoulder 18 of the container 12. The handle arm 42 may extend radially outwardly and axially downwardly from the collar 40. The handle arm 42 may extend from the collar 40 to a radial extent that may be greater than the outer diameter of the container 12.

Referring again to FIG. 4A, the collar 40 may correspond in shape to the container neck 20. For example, the collar 40 may include a wall 44 that may be circular in transverse cross section. More specifically, the wall 44 of the collar 40 may be frustoconical, for example, with a frustoconical outer surface 46 and a frustoconical inner surface 48 and axially opposed ends 50, 52. The collar 40 also may include internal features, for example, annular projections 54, 56 extending inwardly from the axially opposed ends 50, 52 of the wall 44. The annular projections 54, 56 may be axially spaced apart container retention features that engage the retention feature 30 on the external surface 24 of the container neck 20 to prevent axial movement of the collar 40 with respect to the container neck 20. More specifically, the annular projections 54, 56 may include container retention surfaces 58, 60 that face one another, for example in a generally axial direction, and that may contact the corresponding handle retention surfaces 33, 35 of the container 12 to retain therebetween the corresponding handle retention feature 30 of the container 12 to prevent axial movement of the collar 40 with respect to the container 12. The projections 54, 56 also may include neck engagement surfaces 62, 64. The projections 32, 34 are completely covered by the handle collar 40 when the handle 14 is coupled to the container 12.

Figure 5:
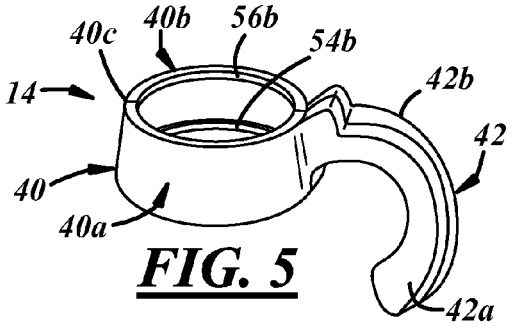
FIG. 5 is a perspective view of a handle from the container and handle assembly of FIG. 1.
Figure 7:
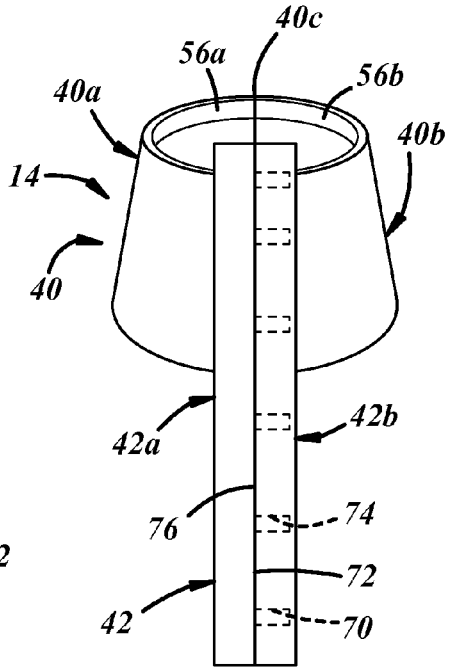
FIG. 7 is an enlarged rear perspective view of the handle from FIG. 5, illustrated in a closed position.
Figure 6:
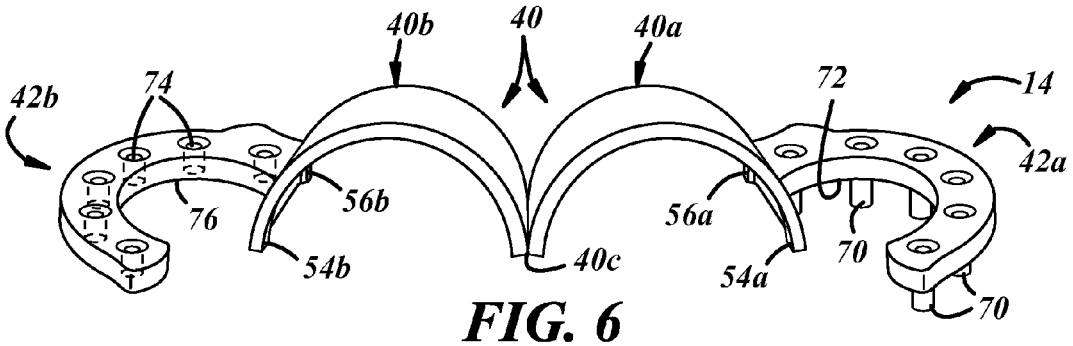
FIG. 6 is an enlarged perspective view of the handle from FIG. 5, illustrated in an open position.

Referring to FIGS. 5 through 7, the collar 40 includes first and second semi-circular portions 40*a*, 40*b* connected by a living hinge 40*c*, and the handle 14 also includes first and second handle arms 42*a*, 42*b* respectively extending from the first and second semi-circular portions 40*a*, 40*b*. The first and second semi-circular portions 40*a*, 40*b* each include semi-conical walls 44*a*, 44*b* and axially spaced apart semi-circular projections 54*a,b* and 56*a,b* extending inwardly from the semi-conical walls 44*a*, 44*b*.

The first and second handle arms 42*a*, 42*b* include one or more handle arm retention features to couple the first and second handle arms 42*a*, 42*b* together. For example, the first handle arm 42*a* may include pins 70 extending from a first inner surface 72, and the second handle arm 42*b* may include sockets 74 that may extend into a second inner surface 76 that corresponds to the first inner surface 72. The handle arms 42*a*, 42*b* may be brought together so that the pins 70 are inserted into the corresponding sockets 74. In one example, the pins 70 may be interference or snap-fit into the sockets 74. In another example, the pins 70 may be loose fit into the sockets 74 and then upset or headed to compression fit the pins 70 in the sockets 74 after assembly of the handle 14 to the container 12.

Figure 8:
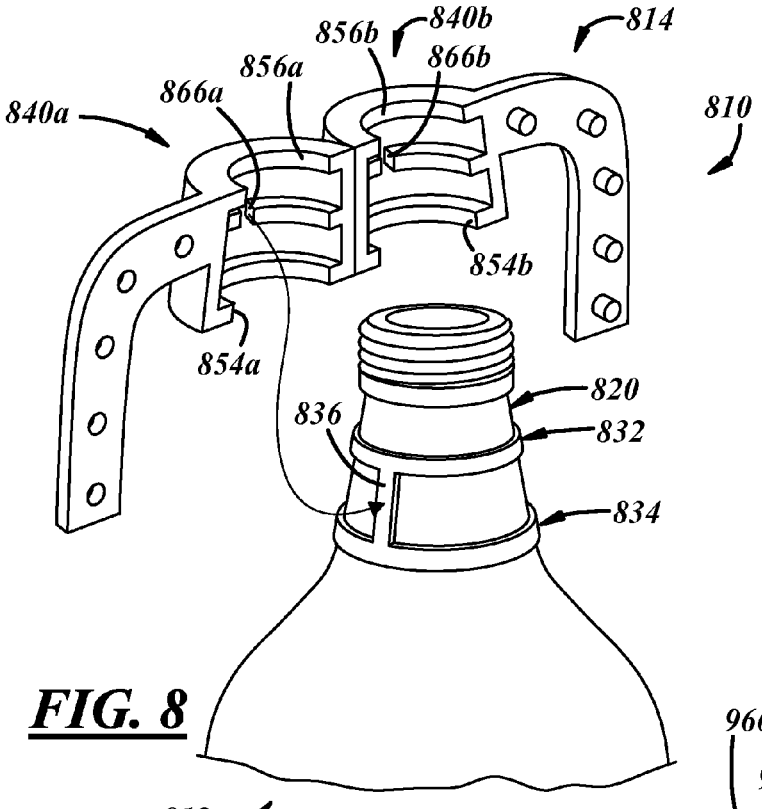
FIG. 8 is a fragmentary, exploded, perspective view of a container and handle assembly according to another illustrative embodiment of the present disclosure, illustrating additional retention and anti-rotation features.

FIG. 8 illustrates an additional illustrative embodiment of a container and handle assembly 810. This embodiment is similar in many respects to the embodiment of FIGS. 1-7 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 8 illustrates another arrangement of handle and container retention features for the assembly 810. For example, the assembly 810 may include a container 812 having a neck 820 with handle retention features 832, 834 in the form of annular ribs or projections, and a handle anti-rotation feature 836. The anti-rotation feature 836 may be in the form of a longitudinal rib or projection that extends between, and may be connected to, the other retention features 832, 834. Likewise, the assembly 810 may include a handle 814 having a collar 840*a*, 840*b* with container retention features 854*a*, 854*b*, 856*a*, 856*b* in the form of annular ribs or projections, and a container anti-rotation feature 866*a*, 866*b*. The anti-rotation feature 866*a*, 866*b* may be in the form of a discontinuity or gap between semi-circumferential annular projections longitudinally between the other retention features 854*a*, 854*b*, 856*a*, 856*b*. The anti-rotation feature 836 of the container 812 fits in the gap to prevent rotation between the handle 814 and the container 812.

Figure 9:
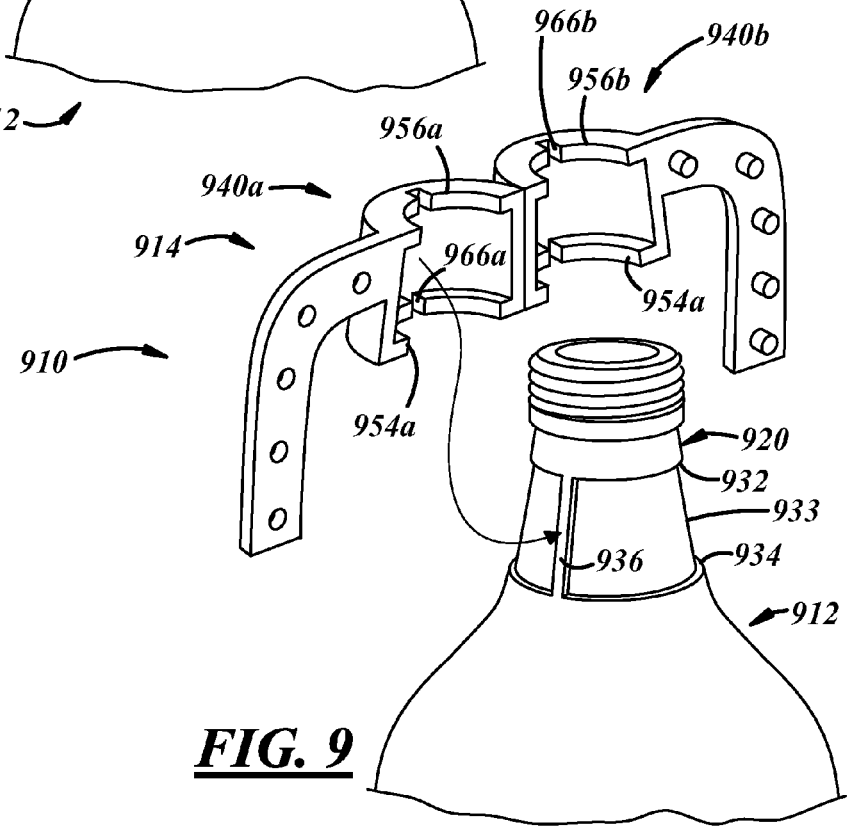
FIG. 9 is a fragmentary, exploded, perspective view of a container and handle assembly according to a further illustrative embodiment of the present disclosure, illustrating further retention and anti-rotation features.

FIG. 9 illustrates an additional illustrative embodiment of a container and handle assembly 910. This embodiment is similar in many respects to the embodiment of FIGS. 1-8 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 9 illustrates another arrangement of handle and container retention features for the assembly 910. For example, the assembly 910 may include a container 912 having a neck 920 with handle retention features 932, 934 in the form of axially lower and upper annular handle retention surfaces or shoulders that may be established by an annular depression 933 in the outer surface of the neck 920, and a handle anti-rotation feature 936. The anti-rotation feature 936 may be in the form of a longitudinal rib or projection that extends between, and may be connected to, the other retention features 932, 934. Likewise, the assembly 910 may include a handle 914 having a collar 940*a*, 940*b* with container retention features 954*a*, 954*b*, 956*a*, 956*b* in the form of annular ribs or projections, and a container anti-rotation feature 966*a*, 966*b*. The anti-rotation feature 966*a*, 966*b* may be in the form of a discontinuity or gap between the semi-circumferential retention features 954*a*, 954*b*, 956*a*, 956*b* themselves. The anti-rotation feature 936 of the container 912 fits in the gap to prevent rotation between the handle 914 and the container 912. The features 932, 934 are spaced apart across the recess or depression 933 in the external surface of the container neck 920 and that trap the container retention features 954*a,b*, 956*a,b* of the handle collar 940*a,b* when the handle 914 is coupled to the container 912.

Figure 10:
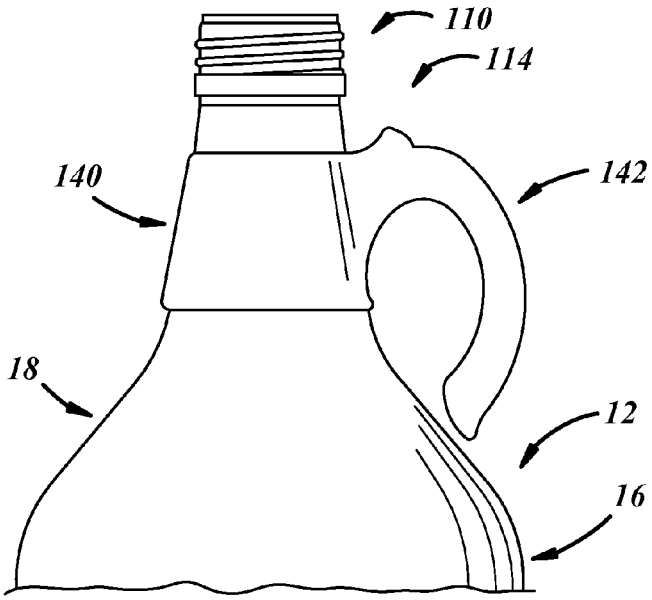
FIG. 10 is a fragmentary side elevational view of a container and handle assembly in accordance with another illustrative embodiment of the present disclosure.
Figure 11:
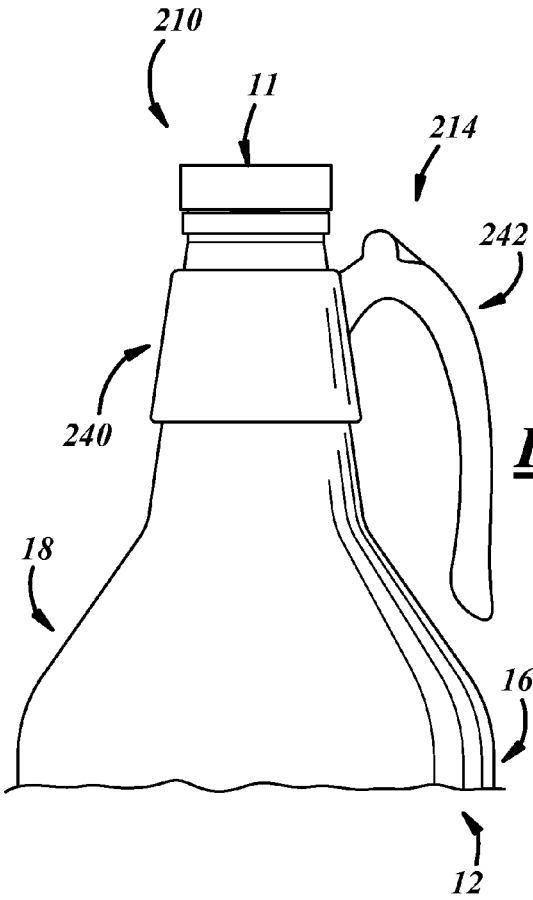
FIG. 11 is a fragmentary side elevational view of a container and handle assembly in accordance with a further illustrative embodiment of the present disclosure.

FIGS. 10 and 11 illustrate additional illustrative embodiments of container and handle assemblies 110, 210. These embodiments are similar in many respects to the embodiment of FIGS. 1-9 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Referring to FIGS. 10 and 11, the assemblies 110, 210 include the container 12 and handles 114, 214 coupled to the container 12. In these embodiments, the handles 114, 214 include collars 140, 240 and handle arms 142, 242 coupled to the collars 140, 240 and extending from the collars 140, 240 to a radial extent that is no greater than the outer diameter of the container 12. FIG. 11 also illustrates a closure 11 coupled to the container 12.

FIGS. 12-15 illustrate another illustrative embodiment of a container and handle assembly 310. This embodiment is similar in many respects to the embodiment of FIGS. 1-11 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 12:
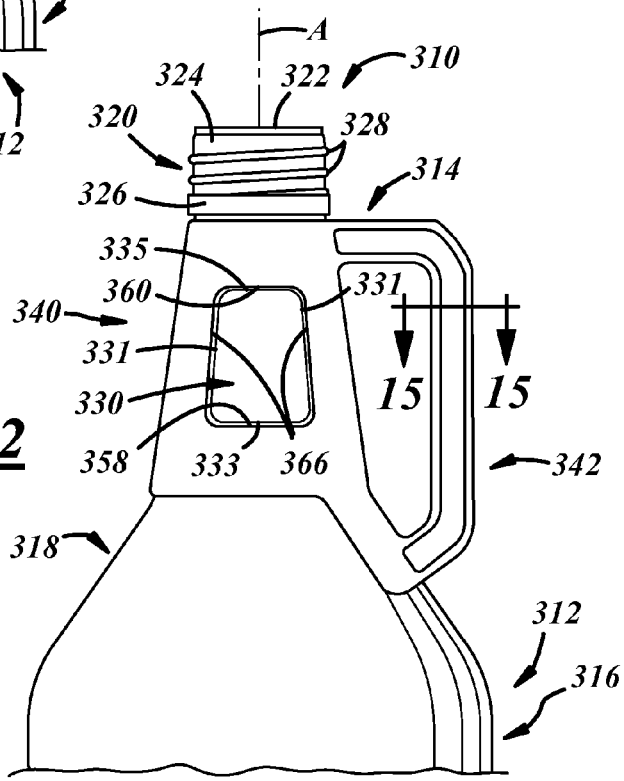
FIG. 12 is a fragmentary side elevational view of a container and handle assembly in accordance with an additional illustrative embodiment of the present disclosure.
Figure 13:
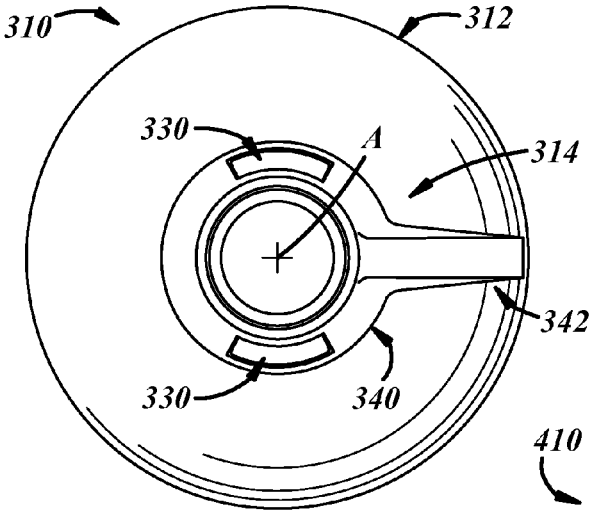
FIG. 13 is a top view of the container and handle assembly of FIG. 12.
Figure 14:
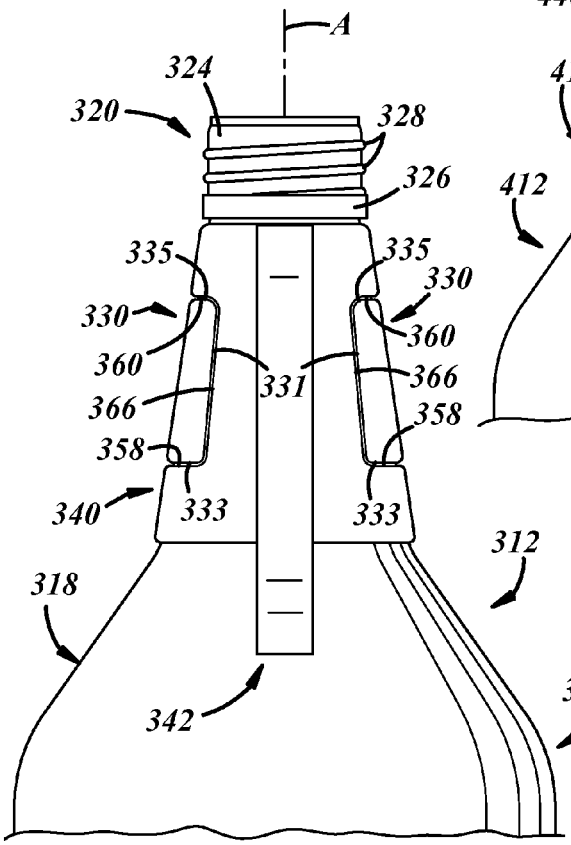
FIG. 14 is a fragmentary rear elevational view of the container and handle assembly of FIG. 12.

With reference to FIG. 12, the assembly 310 includes a container 312 and a handle 314 coupled to the container 312. The container 312 includes a shoulder 318 extending radially and axially from a body 316, and a neck 320 extending from the shoulder 318. The neck 320 includes an axial end surface 322, a radially outer external surface 324, an annular flange 326 extending radially from the external surface 324, and a closure retention feature 328 axially between the annular flange 326 and the axial end surface 322. The neck 320 also includes a handle retention feature, which may include one or more external embossments or debossments. Those of ordinary skill in the art will recognize that the retention features of the container and handle may be reversed, for example, to include projections on the container and corresponding depressions in the handle For example, as shown in FIG. 13, the handle retention feature may include a pair of bosses or projections 330 spaced circumferentially from each other on the container neck. For instance, the projections 330 may be spaced 180° apart. With reference to FIG. 14, the handle retention feature is located axially between and spaced apart from the annular flange 326 and the shoulder 318 and includes axially lower and upper handle retention surfaces 333, 335 that face away from one another, for example, in axially opposite directions. The handle retention feature also may include side handle retention surfaces 331 that face away from one another, for example, in circumferentially opposite directions to prevent rotation of the handle 314 on the container 312. In this embodiment, the feature may be parallelogram-shaped as viewed perpendicularly to a radially outward surface thereof, as shown in FIG. 12.

With reference to FIG. 12, the handle 314 includes a collar 340 surrounding the neck 320 of the container 312 and a handle arm 342 extending from the collar 340. The collar 340 may be coupled to the container neck 320 below the annular flange 326 and/or above the shoulder 318 of the container 312. The handle arm 342 may extend radially outwardly and axially downwardly from the collar 340. The handle arm 342 may extend from the collar 340 to a radial extent that may be less than or equal to the outer diameter of the container 12.

The collar 340 includes a wall 344 that may be circular in transverse cross section and may correspond in shape to that of the container neck 320. For example, the wall 344 may be frustoconical and may be coupled to the container neck 320 with an interference fit, for instance, via a snap-fit over the container neck 320. More specifically, the frustoconical collar may be press fit over the container neck 320, and/or may be shrink fit thereto, for example, by heating the collar before assembly to the container neck 320 to expand the collar, and then cooling the collar or allowing the collar to cool and shrink around the neck 320. The wall 344 may includes a container retention feature, which may include two or more circumferentially spaced apart container retention features. The container retention features may include one or more internal debossments or embossments.

For example, the container retention features may include a pair of reliefs in the wall 344 spaced circumferentially from each other and corresponding to the pair of handle retention projections 330 on the container neck 320, wherein the projections 330 extend into the reliefs to axially and circumferentially retain the handle collar 340 to the container neck 320. The reliefs may be diametrically opposed or circumferentially spaced 180 degrees apart from one another. The reliefs engage the corresponding retention features on the external surface 324 of the container neck 320 to prevent axial movement of the collar 340 with respect to the container neck 320. In this embodiment, the reliefs may include apertures through the handle collar wall 344 and through which the handle retention projections 330 at least partially extend.

The apertures may be partly established by axially lower and upper container retention surfaces 358, 360 that face one another, for example in a generally axial direction. The surfaces 358, 360 may contact the corresponding axially lower and upper handle retention surfaces 333, 335 of the container neck 320 to retain therebetween the corresponding handle retention feature 330 of the container 312 to prevent axial movement of the collar 340 with respect to the container neck 320. The apertures also may be partly established by side container retention surfaces 366 that face one another, for example in a generally circumferential direction. The surfaces 366 may contact the corresponding side handle retention surfaces 331 of the container neck 320 resist rotation of the handle collar 340 on the container neck 320.

Figure 15:
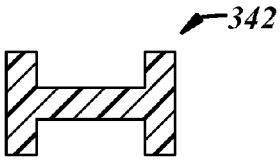
FIG. 15 is an enlarged cross-sectional view of a portion of a handle of the container and handle assembly of FIG. 12, taken along line 15-15 of FIG. 12.
Figure 16:
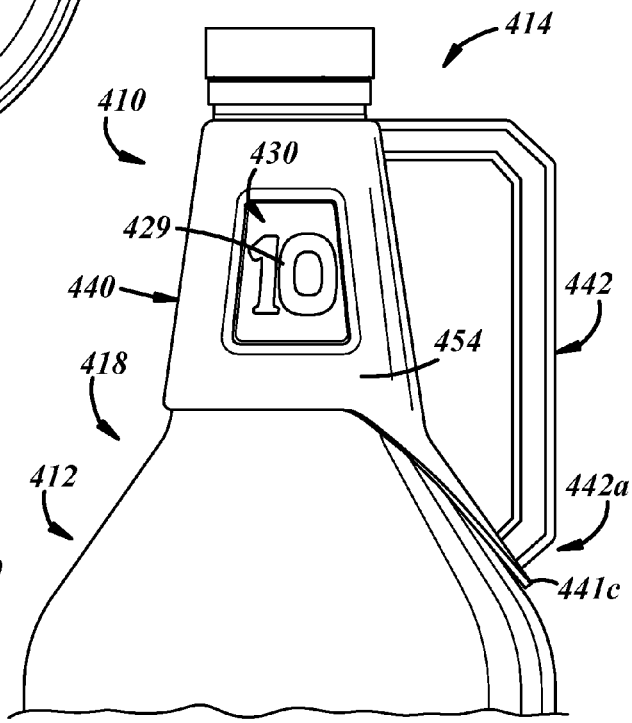
FIG. 16 is a fragmentary side elevational view of a package including a container and handle assembly and a closure in accordance with yet another illustrative embodiment of the present disclosure.
Figure 17:
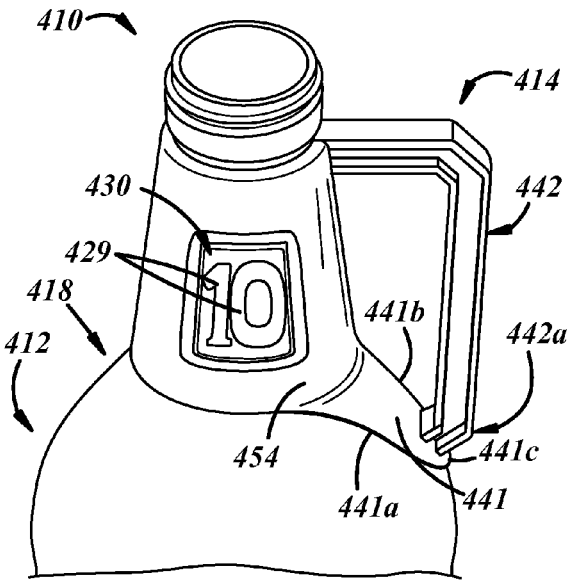
FIG. 17 is a fragmentary perspective view of the container and handle assembly of FIG. 16 without the closure.
Figure 18:
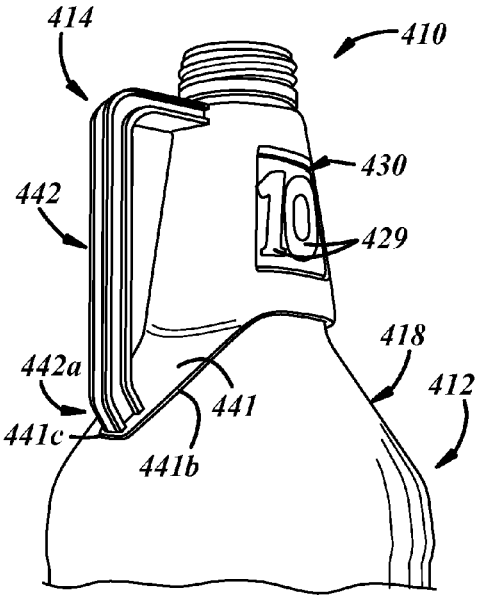
FIG. 18 is a fragmentary perspective view of the container and handle assembly of FIG. 16 without the closure.

FIGS. 16-18 illustrate another illustrative embodiment of a container and handle assembly 410. This embodiment is similar in many respects to the embodiment of FIGS. 1-15 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The assembly 410 includes a container 412 and a handle 414 coupled to the container 412. The assembly 410 is substantially similar to the assembly 310 of FIGS. 12-15.

For example, the container 412 is substantially similar to the container 312 of FIGS. 12-15, except that radially outer surfaces of handle retention features 430 include indicia 429. For example, the indicia 429 may include a brand name, logo, or the like. The indicia 429 may include integral features that extend radially outwardly from the outer surfaces of the handle retention features 430 or may be recessed therein, or may be separate features, for example, labels, printings, or the like.

In another example, the handle 414 includes a handle arm 442 having an axially lower portion 442*a*, and a skirt portion 441 connected to the lower portion 442*a* of the handle arm 442 and to a lower end 454 of the collar 440. The skirt portion 441 extends axially downwardly and radially outwardly from the collar 440 to correspond with or follow the shape of a container shoulder 414 and may contact the shoulder 418. The skirt portion 441 may be wider in a circumferential direction where the skirt portion 441 connects to the collar 440 and narrower where the skirt portion 441 connects to the handle arm 442. Accordingly, as shown in FIGS. 15 and 16, the skirt portion 441 may have converging circumferential sides 441*a*, 441*b* and an apex 441*c*.

Figure 21:
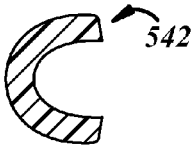
FIG. 21 is an enlarged cross-sectional view of a portion of a handle of the container and handle assembly of FIG. 19, taken along line 21-21 of FIG. 19.
Figure 19:
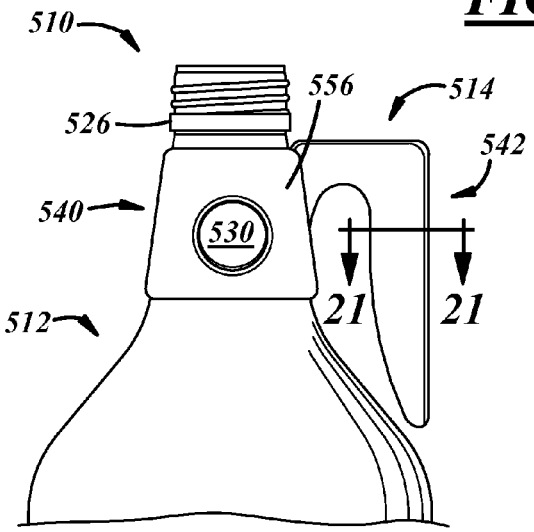
FIG. 19 is a fragmentary side elevational view of a container and handle assembly in accordance with still another illustrative embodiment of the present disclosure.
Figure 20:
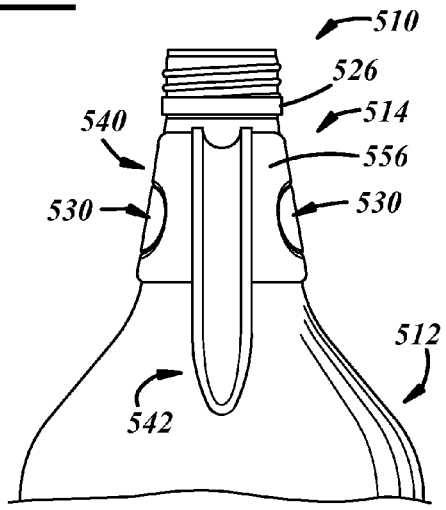
FIG. 20 is a fragmentary rear elevational view of the container and handle assembly of FIG. 19.

FIGS. 19-21 illustrate another illustrative embodiment of a container and handle assembly 510. This embodiment is similar in many respects to the embodiment of FIGS. 1-18 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The assembly 510 includes a container 512 and a handle 514 coupled to the container 512. The assembly 510 is substantially similar to the assembly 310 of FIGS. 12-15, with a few exceptions. For example, a collar 540 is somewhat different. First, handle retention features 530 are circle-shaped when viewed perpendicularly to a radially outer surface thereof. Second, lower and upper axial surfaces of the collar 540 are spaced apart from a container flange 526 and shoulder 518. In another example, a handle arm 542 is somewhat different. First, the handle arm 542 may include a rounded cross-sectional shape as shown in FIG. 21.

Second, the handle arm 542 may be cantilevered from the collar 540 and is connected thereto at an upper end 556 thereof.

Figure 22:
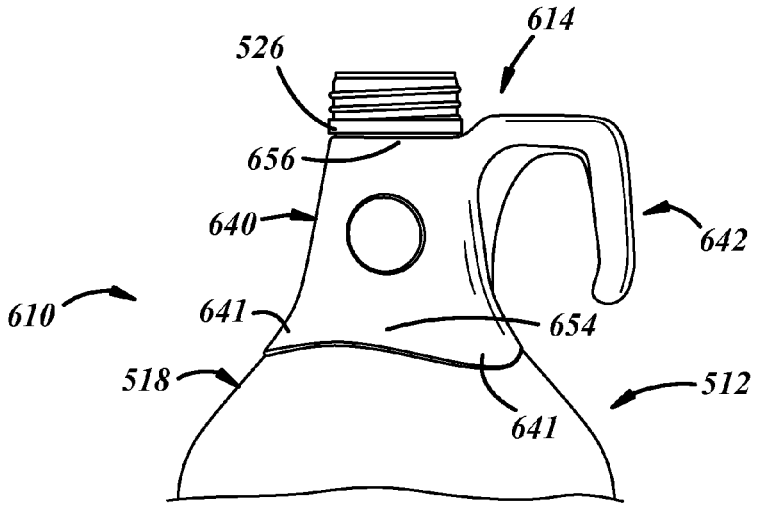
FIG. 22 is a fragmentary perspective view of a container and handle assembly in accordance with still a further illustrative embodiment of the present disclosure.

FIG. 22 illustrates another illustrative embodiment of a container and handle assembly 610. This embodiment is similar in many respects to the embodiment of FIGS. 1-21 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The assembly 610 includes the container 512 and a handle 614 coupled to the container 512. The assembly 610 is substantially similar to the assembly 510 of FIGS. 19-21, with a few exceptions. For example, a collar 640 is somewhat different. Lower and upper axial ends 654, 656 of the collar 640 are in axial contact with and between an annular flange 526 and a shoulder 518. In fact, the collar 640 includes a circumferentially continuous skirt 641 that extends over a portion of the shoulder 518 and in contact therewith. Accordingly, the collar 640 is trapped between the flange 526 and shoulder 518 for additional rigidity.

Figure 23:
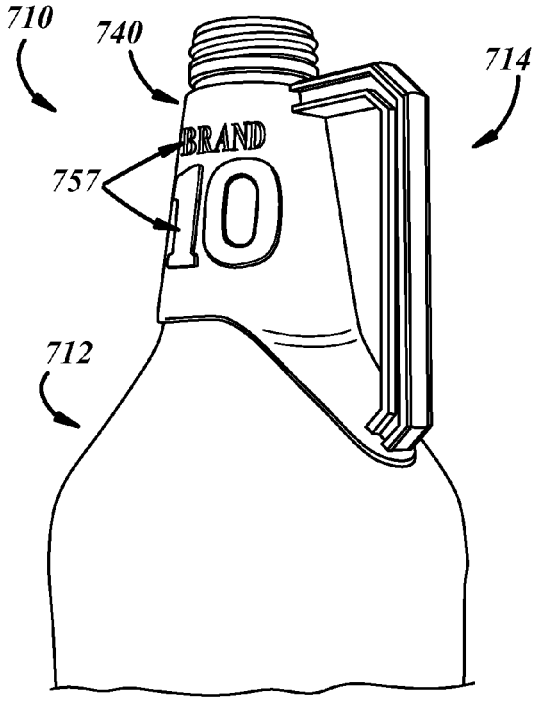
FIG. 23 is a fragmentary perspective view of a container and handle assembly in accordance with yet a further illustrative embodiment of the present disclosure.
Figure 24:
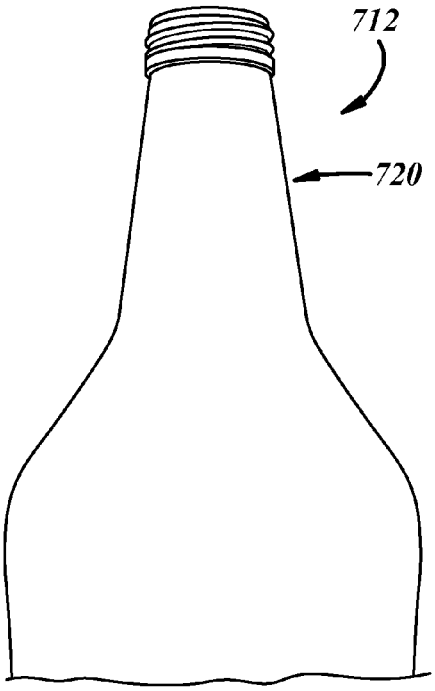
FIG. 24 is a fragmentary perspective view of a container of the container and handle assembly of FIG. 23.

FIGS. 23-24 illustrate another illustrative embodiment of a container and handle assembly 710. This embodiment is similar in many respects to the embodiments of FIGS. 1-22 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Referring FIG. 23, the assembly 710 includes a container 712 and a handle 714 coupled to the container 712. The assembly 710 is substantially similar to the assembly 410 of FIGS. 16-18, with a few exceptions. For example, as shown in FIG. 23, the handle 714 may include a handle collar 740 including indicia, e.g., a brand name, logo, or the like, and projecting radially outward from a radially outer surface of the collar 740.

There thus has been disclosed a container and a handle for a container, that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A handle and container assembly that includes:

a container including a base, a body extending from the base, a shoulder extending from the body, and a neck extending from the shoulder and including an external surface having a handle retention feature with axially lower and upper handle retention surfaces that face away from one another, wherein the handle retention feature includes a plurality of bosses spaced circumferentially from each other on the container neck; and a handle including a collar surrounding the neck of the container and having axially spaced apart container retention features that engage the axially lower and upper handle retention surfaces of the handle retention feature of the container neck, to prevent axial movement of the collar with respect to the container neck, wherein the handle collar includes a wall corresponding in shape to that of the container neck and a plurality of reliefs in the wall spaced circumferentially from each other and corresponding to the plurality of bosses on the container neck, wherein the bosses extend into the reliefs to axially and circumferentially retain the handle collar to the container neck.

2. The assembly set forth in claim 1 wherein the container neck is frustoconical and includes an annular flange, an axial end surface, and a closure retention feature axially between the annular flange and the axial end surface, wherein the handle collar is coupled to the neck between the annular flange and the container shoulder.

3. The assembly set forth in claim 1 wherein the handle collar includes first and second semi-circular portions connected by a living hinge, and the handle also includes first and second handle arms respectively extending from the first and second semi-circular portions.

4. The assembly set forth in claim 3 wherein at least one of the first and second handle arms includes at least one handle arm retention feature.

5. The assembly set forth in claim 1 wherein the reliefs include apertures through the handle collar wall and through which the bosses at least partially extend.

6. The assembly set forth in claim 1 wherein the reliefs include depressions in an inner surface of the handle collar and into which the bosses at least partially extend.

7. The assembly set forth in claim 1 wherein the handle collar wall is frustoconical and is coupled over the container neck with an interference fit.

8. The assembly set forth in claim 1 wherein the plurality of reliefs includes at least one of a parallelogram, a circle, or indicia.

9. The assembly set forth in claim 1 wherein the container neck is frustoconical and includes an annular flange, an axial end surface, and a closure retention feature axially between the annular flange and the axial end surface, wherein the handle collar is constructed of one piece and coupled to the neck between and in axial contact with the annular flange and the shoulder.

* * * * *